US006474447B2

(12) United States Patent
Tajima et al.

(10) Patent No.: US 6,474,447 B2
(45) Date of Patent: Nov. 5, 2002

(54) ELEVATOR POWER CONTROL FOR ADJUSTING RATIO OF POWER SUPPLIED FROM EACH OF DUAL POWER SOURCES

(75) Inventors: Shinobu Tajima, Tokyo (JP); Hiroshi Araki, Tokyo (JP); Ikuro Suga, Tokyo (JP); Kazuyuki Kobayashi, Tokyo (JP)

(73) Assignees: Mitsubishi Denki Kabushiki Kaisha, Tokyo (JP); The Tokyo Electric Power Company, Inc, Tokyo (JP)

( * ) Notice: Subject to any disclaimer, the term of this patent is extended or adjusted under 35 U.S.C. 154(b) by 0 days.

(21) Appl. No.: 09/742,894

(22) Filed: Dec. 21, 2000

(65) Prior Publication Data

US 2001/0008195 A1 Jul. 19, 2001

(30) Foreign Application Priority Data

Dec. 28, 1999 (JP) ..... 11-374879

(51) Int. Cl.[7] ..... B66B 1/06
(52) U.S. Cl. ..... 187/290; 187/296; 318/801
(58) Field of Search ..... 187/290, 296, 187/391, 393; 318/798–815; 307/66, 69

(56) References Cited

U.S. PATENT DOCUMENTS 4,316,097 A * 2/1982 Reynolds ..... 307/66
4,554,999 A * 11/1985 Kamike ..... 187/29 R
5,638,295 A * 6/1997 Lagree et al. ..... 364/492
5,712,456 A 1/1998 McCarthy et al.
5,894,910 A * 4/1999 Suur-Askola et al. ..... 187/290
5,896,948 A * 4/1999 Suur-Askola et al. ..... 187/290
6,315,081 B1 * 11/2001 Yeo ..... 187/290

FOREIGN PATENT DOCUMENTS

JP 5221590 A * 8/1993 ..... 187/290
JP 5-338947 12/1993

* cited by examiner

*Primary Examiner*—Jonathan Salata
(74) *Attorney, Agent, or Firm*—Leydig Voit & Mayer, Ltd

(57) ABSTRACT

To reduce a total power amount required to drive an elevator by a commercial power supply during a peak power-consumption time period, for instance, afternoon in summer time, a control apparatus for this elevator is arranged by employing: a converter for rectifying AC electric power to be converted into DC electric power; and inverter for inverting the DC electric power into AC electric power having a variable voltage and a variable frequency; a motor driven by said AC electric power having the variable voltage and the variable frequency so as to operate an elevator; a power storage apparatus for charging thereinto electric power; and a power controller for using both the power storage apparatus and the commercial power supply so as to supply the electric power to the inverter, and for controlling at least any one of the power storage apparatus and the commercial power supply in order to supply electric power which is required for the inverter.

6 Claims, 9 Drawing Sheets

ELEVATOR POWER CONTROL FOR ADJUSTING RATIO OF POWER SUPPLIED FROM EACH OF DUAL POWER SOURCES

BACKGROUND OF THE INVENTION

1. Field of the Invention

The present invention generally relates to an elevator control apparatus using a power storage apparatus.

2. Description of the Related Art

One conventional control apparatus of an elevator is indicated in FIG. 9. Referring now to a structural arrangement of FIG. 9, this conventional elevator control apparatus includes a motor 2, such as an induction motor, coupled to a commercial AC power supply 1 (referred to as a "commercial power supply" hereinafter), a drive machine 3, a rope 4, a car 5 of the elevator, and a balance weight 6. Both the elevator car 5 and the balance weight 6 connected to opposite ends of the rope 4 can be elevated by rotary-driving this drive machine 3. As a result, passengers in the elevator car 5 can be conveyed to a predetermined floor.

In FIG. 9, reference numeral 8 shows a controller. The controller 8 determines starting/stopping of the elevator, and produces a position/speed instruction of this elevator. Reference numeral 11 indicates a converter which is constructed of a diode and the like. This converter 11 rectifies AC electric power supplied from the commercial power supply 1 to produce DC electric power. Reference numeral 15 represents an inverter which is constructed of a transistor, an IGBT (Insulated-Gate Bipolar Transistor), and the like. This inverter 15 inverts the DC electric power converted by the converter 11 into AC electric power having a variable AC voltage and a variable AC frequency. Reference numeral 16 shows a regenerative resistor. This regenerative resistor 16 is connected to a bus line existing between the converter 11 and the inverter 15. Also, reference numeral 17 indicates a regenerative resistor control circuit which is connected to both the regenerative resistor 16 and the bus line.

The above-explained balance weight 6 of the elevator is designed to be balanced when the properly-selected number of passengers get into the elevator car 5. As this properly-selected number of passengers, for example, half of the number of a capacity of this car 5 may be selected. Now, in such a case that the entire weight of the car 5 into which this properly-selected number of passengers gets is balanced with the balance weight 6, operation of this elevator (car 5) will now be considered. When this elevator is accelerated, the speed of this elevator is increased while this elevator consumes the electric power supplied from the commercial power supply 1. Conversely, when the elevator is decelerated, the speed of this elevator is decreased while returning the stored kinetic energy to the corresponding electric power supply. In this case, such an elevator operation in which a speed of this elevator is increased while consuming electric power supplied from this commercial power supply 1 is referred to as a "powering operation." Also, such an elevator operation in which a speed of this elevator is decreased while returning kinetic energy to electric power is referred to as "regenerative operation."

The electric power produced by this regenerative operation is converted into thermal energy by both the regenerative resistor 16 and the regenerative resistor control circuit 17 so as to be consumed.

Also, reference numeral 7 shows an encoder which is provided on the drive machine 3. Reference numeral 12 indicates a current detecting apparatus. This current detecting apparatus 12 is provided between the motor 2 and the inverter 15. Reference numeral 13 indicates an inverter control circuit which is connected to the encoder 7, the controller 8, and the current detecting apparatus 12. Reference numeral 14 indicates a gate drive circuit which is connected to both the inverter control circuit 13 and the inverter 15.

In response to the instruction issued from the controller 8, the inverter control circuit 13 rotary-drives the motor 2 based on both the current feedback from the current detecting apparatus 12 and the speed feedback from the encoder 7 mounted on the drive machine 3, so that this inverter control circuit 13 can realize both the positional and speed control of the elevator. Also, the inverter control circuit 13 controls the output voltage and frequency of the inverter 15 via the gate drive circuit 14.

The conventional elevator control apparatus continuously receives the supply of electric power from the commercial power supply 1 to operate this elevator irrespective of degree of power demands. For example, peak electric power is required in the afternoon of summer time. During this time period, a total power consumption is wanted to be reduced. However, the conventional elevator control apparatus can hardly reduce total power consumption during such a peak power-consumption time period.

As previously explained, since the electric power is consumed in synchronization with the elevator operation in the conventional elevator control apparatus, total power consumption during the peak power-consumption time period cannot be reduced.

SUMMARY OF THE INVENTION

The present invention has been made to solve the above-explained problems, and therefore, has an object to provide an elevator control apparatus reducing total power consumption of a commercial power supply.

An elevator control apparatus, according to an aspect of the present invention, is comprised of: a converter for rectifying AC electric power to be converted into DC electric power; an inverter for inverting the DC electric power into AC electric power having a variable voltage and a variable frequency; a motor driven by the AC electric power having the variable voltage and the variable frequency so as to operate an elevator; a power storage apparatus for charging thereinto DC electric power; a power controller for controlling at least any one of the power storage apparatus and the commercial power supply in order to supply electric power which is required for said inverter.

Also, a power controller in the elevator control apparatus, according to the present invention, controls both a power supply amount from the power storage apparatus and a power supply amount from the commercial power supply.

Further, a power controller in the elevator control apparatus, according to the present invention, controls a supply ratio of a power supply amount from the power storage apparatus to a power supply amount from the commercial power supply.

Also, a power controller in the elevator control apparatus, according to the present invention, detects a voltage appearing on a bus line connected between the converter and the inverter so as to control a power supply amount from the power storage apparatus.

Further, a power controller in the elevator control apparatus, according to the present invention, limits a current value of electric power supplied from the power storage apparatus.

Moreover, a power controller in the elevator control apparatus, according to the present invention, controls a maximum value of a power supply amount from the power storage apparatus.

Also, a power controller in the elevator control apparatus, according to the present invention, controls a maximum value of a power supply amount from the commercial power supply.

In addition, according to the elevator control apparatus of the present invention, a difference power amount between a power supply amount to the inverter and a maximum power supply amount from one power supply is supplied from the other power supply.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Referring now to drawings, various preferred embodiments of the present invention will be described more in detail.

Embodiment Mode 1

Figure 1:
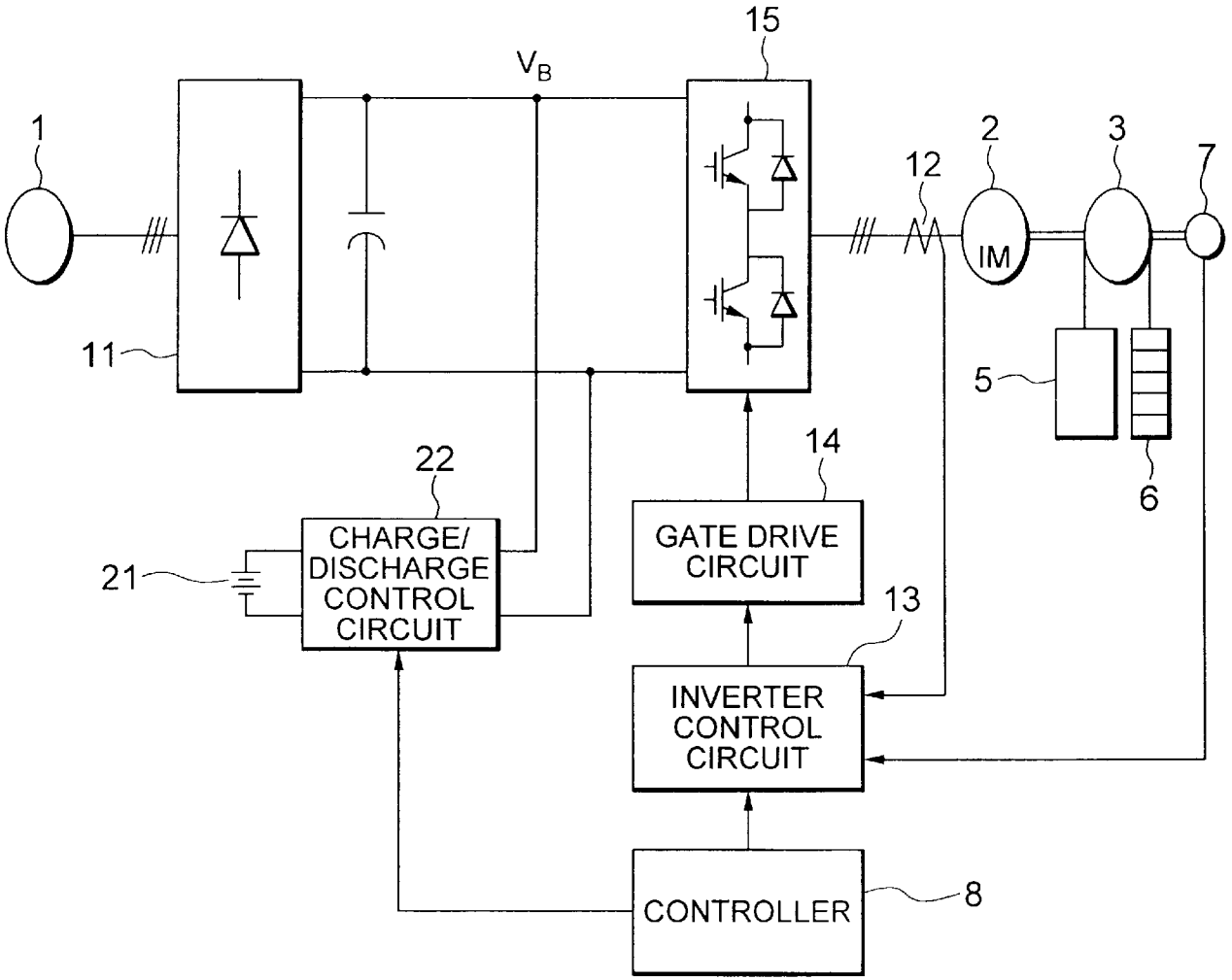
FIG. 1 schematically indicates an arrangement of a control apparatus of an elevator, according to an embodiment mode 1 of the present invention.

First, a control apparatus of an elevator, according to an embodiment mode 1 of the present invention, will now be described with reference to FIG. 1. That is, FIG. 1 is a structural diagram schematically indicating an arrangement of the elevator control apparatus according to this embodiment mode 1. In FIG. 1, reference numeral 20 indicates a switching command. This switching command 20 corresponds to a signal supplied from a controller 8 to a charge/discharge control circuit 22. This switching command 20 corresponds to a signal for instructing a supply ratio of electric power which is supplied from both a commercial power supply 1 and a power storage apparatus 21.

Also, reference numeral 21 indicates a power storage apparatus which is constituted by a battery and the like. This power storage apparatus 21 may be charged by using regenerative power produced when an elevator is driven in a regenerative operation mode, and/or may be charged by using the commercial power supply 1. Since the power storage apparatus 21 is charged by way of such regenerative power, a charging amount by the commercial power supply 1 may be reduced.

Reference numeral 22 indicates a charge/discharge control circuit which is arranged by a DC/DC converter and the like. This charge/discharge control circuit 22 is connected to the controller 8, the power storage apparatus 21, bus lines coupled between the converter 11 and the inverter 15. It should be noted this charge/discharge control circuit 22 corresponds to a power controller.

Figure 9:
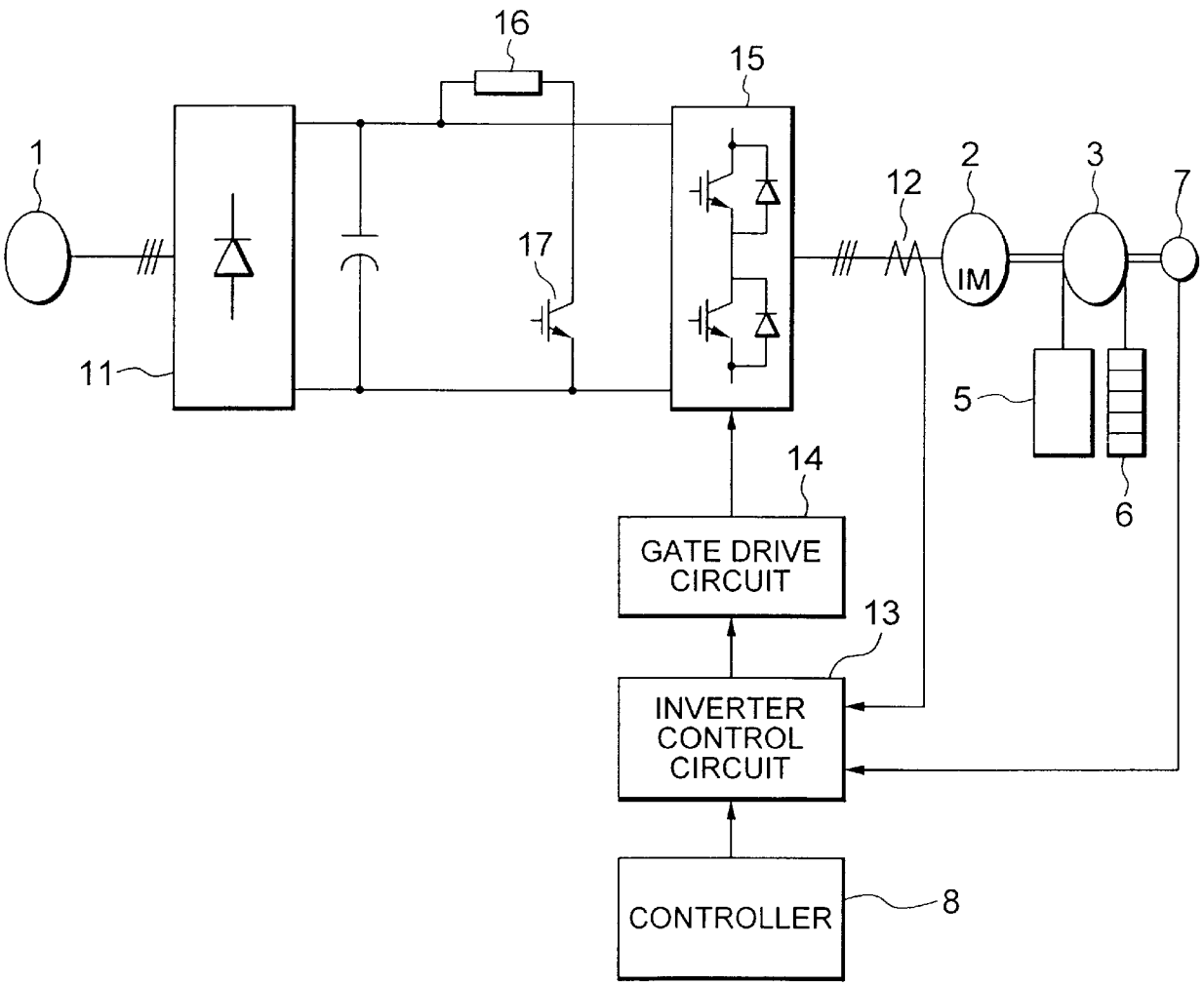
FIG. 9 schematically shows an arrangement of an elevator control apparatus of a conventional elevator control apparatus.

It should also be noted that the same reference numerals shown in a conventional elevator control apparatus of FIG. 9 will be employed as those for indicating the same, or similar circuit elements indicated in FIG. 1, and descriptions thereof are omitted. Therefore, only different circuit elements will be explained.

Figure 2:
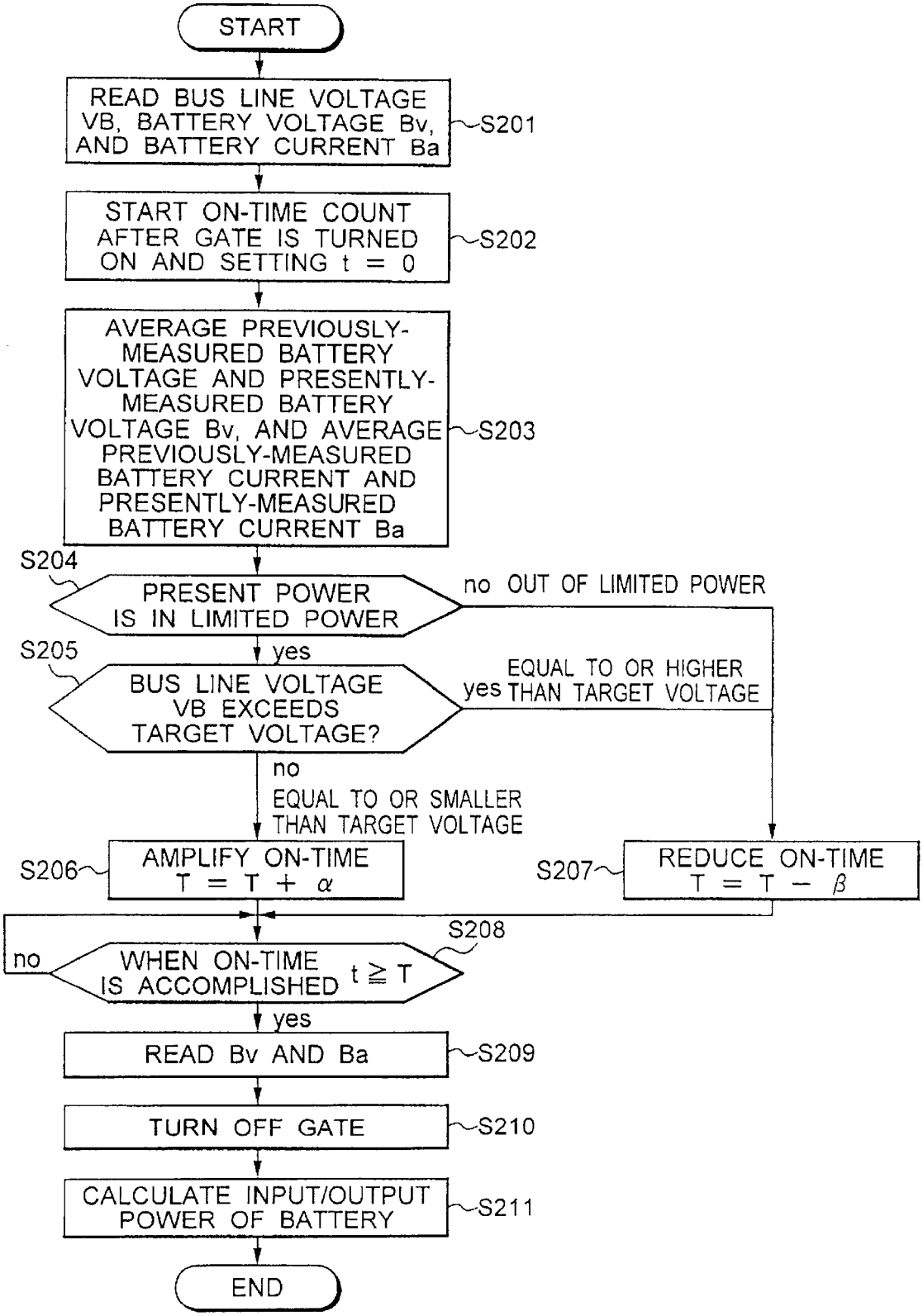
FIG. 2 is a flow chart describing an elevator control method executed in the first elevator control apparatus according to the embodiment mode 1 of the present invention.

Referring now to FIG. 2, a description will be made of an elevator control method executed in the elevator control apparatus according to this first embodiment mode. That is, FIG. 2 is a flow chart describing one example of the elevator control method performed in the elevator control apparatus of the first embodiment mode. In this first embodiment mode, the following assumption is made. That is, electric power is supplied to the elevator up to a predetermined power supply amount by using the commercial power supply 1, and electric power is further supplied thereto when the supplied power exceeds this predetermined power supply amount by employing the power storage apparatus 21.

In FIG. 2, at a step (hereinafter abbreviated to S) 201, the charge/discharge control circuit 22 measures a bus line voltage "VB" corresponding to an input voltage to the inverter 15. Also, the charge/discharge control circuit 22 measures an output voltage "Bv" of the power storage apparatus 21 before the gate of this charge/discharge control circuit 22 is opened. When the process operation defined at this S201 is ended, the process operation is advanced to a S202.

At the S202, the charge/discharge control circuit 22 opens the gate of this charge/discharge control circuit 22. Then, the charge/discharge control circuit 22 starts to count time during which the current-carrying operation of this charge/discharge control circuit 22 is performed due to the opening of the gate thereof, namely ON-time corresponding to a time period during which the gate of this charge/discharge control circuit 22 is opened. Also, the charge/discharge control circuit 22 measures an output current "Ba" derived from this charge/discharge control circuit 22 when the gate thereof is opened. When the process operation defined at this S202 is ended, the process operation is advanced to a S203.

At this S203, the charge/discharge control circuit 22 calculates an average value between the previously-measured output voltage Bv and the presently-measured output voltage Bv, and also another average value between the previously-measured output current Ba and the presently-measured output current Ba. It should also be understood that the reason why the average values of these output voltages Bv and output currents Ba are calculated is to improve stable control operation. However, the present invention is not limited only to this stabilizing method of control operation. When the process operation defined at this S203, the process operation is advanced to a S204.

At this S204, the charge/discharge control circuit 22 judges as to whether or not the present power is in limited power. When the present power is in the limited power, the process operation is advanced to a S205. Otherwise, the process operation is advanced to a S207.

At this S205, the charge/discharge control circuit 22 judges as to whether or not the bus line voltage VB is equal to or higher than a target voltage. When the bus line voltage VB is equal to or higher than this target voltage, the process operation is advanced to a further S207. Otherwise, the process operation is advanced to another S206.

At this 206, the charge/discharge control circuit 22 amplifies the ON-time. In other words, in such a case that the bus line voltage VB is lower than a predetermined target voltage, the charge/discharge control circuit 22 prolongs the ON-time of this gate so that electric power is supplied to the DC main circuit and thus, the bus line voltage VB is increased. When this process operation defined at the S206 is ended, the process operation is advanced to a S208.

At the S207, the charge/discharge control circuit 22 reduces, or shortens the ON-time. In other words, in such a case that the bus line voltage VB is equal to or higher than a predetermined target voltage, the charge/discharge control circuit 22 shortens the ON-time of the gate, so that only a small amount of electric power is supplied to the DC main circuit and thus, the bus line voltage VB is lowered. When this process operation defined at this S207 is ended, the process operation is advanced to a S208.

At the S208, the charge/discharge control-circuit 22 judges as to whether or not predetermined ON-time has been accomplished. When the predetermined ON-time has been accomplished, the process operation is advanced to a S209. Otherwise, the process operation is again returned to the previous S208 at which the process operation thereof is executed.

At the S209, the charge/discharge control circuit 22 measures both the output voltage Bv and the output current Ba. When the process operation defined at this S209 is ended, the process operation is advanced to a S210.

At this S210, the charge/discharge control circuit 22 closes the gate of the charge/discharge control circuit 22. When the process operation defined at this S210 is ended, the process operation is advanced to a S211.

At this S211, the charge/discharge control circuit 22 calculates input/output power with respect to the power storage apparatus 21 based on the current value and the voltage value of the ON-time.

It should be understood that the computer program executable in accordance with this flow chart shown in FIG. 2 is initiated, for example, every time 50 microseconds have passed.

In the above described embodiment, the elevator is operated by employing the commercial power supply 1 up to a predetermined power supply amount, and is operated by using the power storage apparatus 21 when the supplied power exceeds this predetermined power supply amount. Conversely, the elevator may be alternatively operated by employing the power storage apparatus 21 up to a predetermined power supply amount, and may be alternatively operated by using the commercial power supply 1 when the supplied power exceeds this predetermined power supply amount.

While the power storage apparatus 21 is provided, the regenerative power which has been so far consumed by the regenerative resistor 16 and the like may be again utilized so as to operate the elevator. As a result, a total power consumption of the commercial power supply 1 may be reduced and the extra power may be utilized in a higher efficiency.

Also, while the power storage apparatus 21 is fully charged before the peak power-consumption time period is commenced, the supply of electric power from the commercial power supply 1 is suppressed within the peak power-consumption time period. As a result, such a social need for suppressing the power consumption of this commercial power supply 1 during the peak power-consumption time period can be satisfied.

Furthermore, since the power storage apparatus 21 is provided, the ratio of the power supply amount derived from this power storage apparatus 21 to that derived from the commercial power supply 1 can be controlled. As a consequence, a total power consumption of the commercial power supply 1 during such a peak power consumption time period can be reduced.

Also, since the power storage apparatus 21 is charged during the peak power consumption time period, for example, during night time, a total power consumption in the peak power consumption time period can be suppressed.

In such a method that all of power consumption required for driving the elevator in 1 day are stored into the power storage apparatus 21 by using the night-time power and then the stored power is used during day time, the storage capacity of this power storage apparatus 21 must be increased, resulting in very high cost. Also, in such a case that after all of power consumption required for driving the elevator have been once stored into the power storage apparatus 21, the stored power is discharged therefrom to be consumed, the charging/discharging efficiency will be unnecessary decreased, as compared with such a case that the power is directly consumed to drive the elevator. As a consequence, a following combination method is a more realistic solution. That is, all of the power required to drive the elevator is supplied by combining the power storage apparatus with the commercial power supply.

Embodiment Mode 2

Next, a control apparatus of an elevator, according to a second embodiment mode of the present invention, will now be explained. It should be understood that since an arrangement of the elevator control apparatus according to this second embodiment mode is similar to that of the elevator control apparatus shown in FIG. 1 according to the above-explained first embodiment mode, explanations thereof are omitted.

Figure 3:
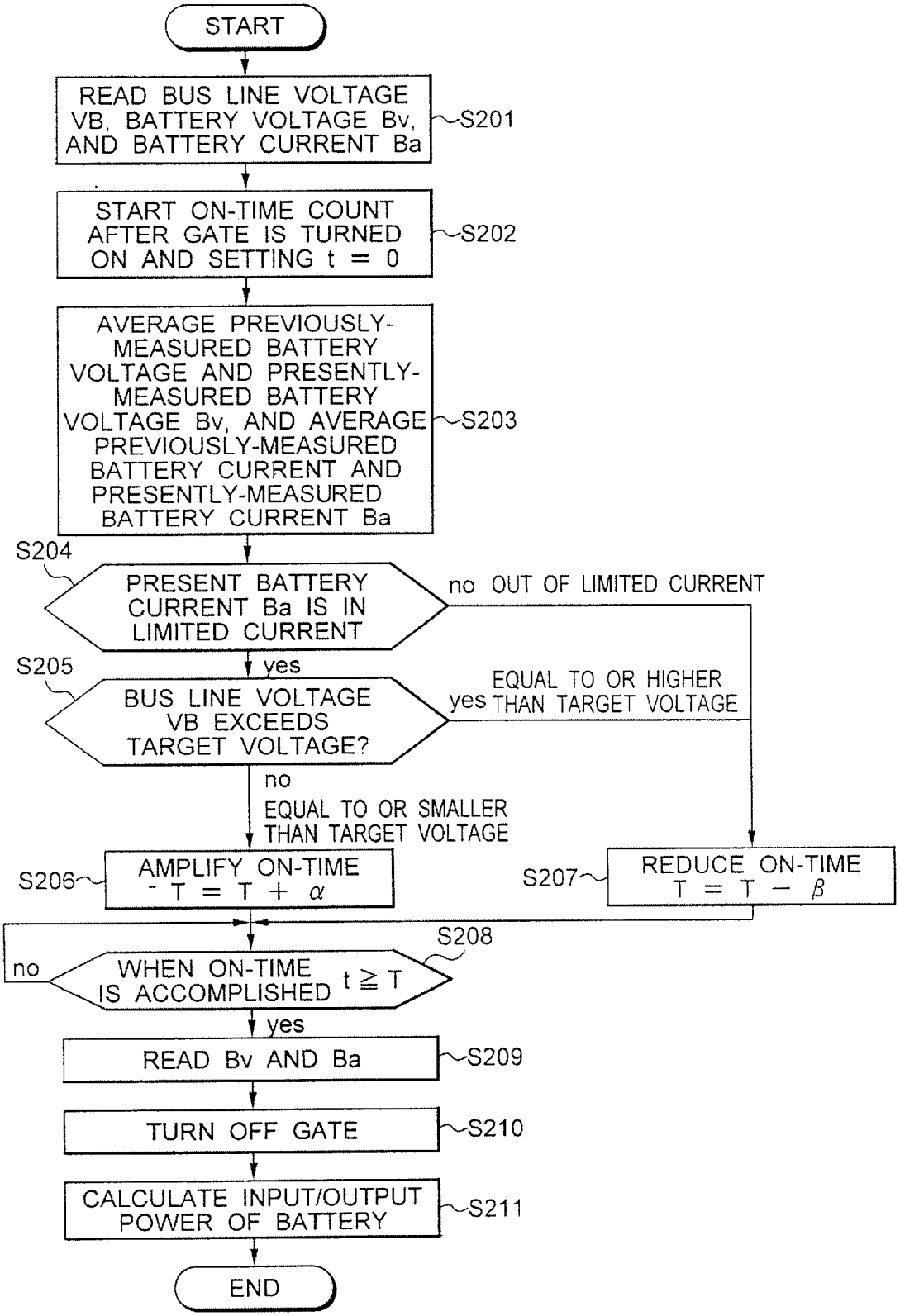
FIG. 3 is a flow chart describing an elevator control method executed in an elevator control apparatus according to an embodiment mode 2 of the present invention.

Subsequently, a description will now be made of an elevator control method executed in the elevator control apparatus according to this second embodiment mode. FIG. 3 is a flow chart explaining an elevator control method executed in the elevator control apparatus according to this second embodiment mode. It should be noted that the same reference numerals shown in the embodiment mode 1 of FIG. 2 will be employed as those for denoting the same, or similar elements indicated in FIG. 3, the explanations thereof are omitted, and then only different portions from those of FIG. 2 will be described.

At a S203 of FIG. 3, the charge/discharge control circuit 22 calculates an average value between the previously-measured output voltage Bv and the presently-measured output voltage Bv, and also another average value between the previously-measured output current Ba and the presently-measured output current Ba. When the process operation defined at this S203 is ended, the control operation is advanced to a S214.

At the S214, the recharging/charging control circuit 22 judges as to whether or not the output current Ba derived from the charge/discharge control circuit 22 when the gate thereof is opened is located within a predetermined current range. When this output current Ba is in this predetermined current range, the process operation is advanced to a S205. Conversely, the process operation is advanced to a S207.

It should also be noted that the ON-time is decreased by limiting the output current Ba and thus the bus line voltage VB is not reached to a predetermined voltage, the reduced power which is required to drive the elevator is automatically supplied from the commercial power supply 1.

As explained above, since the output current Ba is suppressed within a predetermined range, it is possible to prevent such a rapid discharge operation, and also possible to extend lifetime of the power storage apparatus 21.

Also, while the output current Ba produced when the power storage apparatus 21 discharges therefrom the stored power is limited, the reduced power which is required to drive the elevator is supplied from the commercial power supply 1. As a consequence, such an elevator control apparatus can be obtained which is equipped with the power storage apparatus 21 whose lifetime is extended, while supplying the necessary power to the inverter 15.

Embodiment Mode 3

Figure 4:
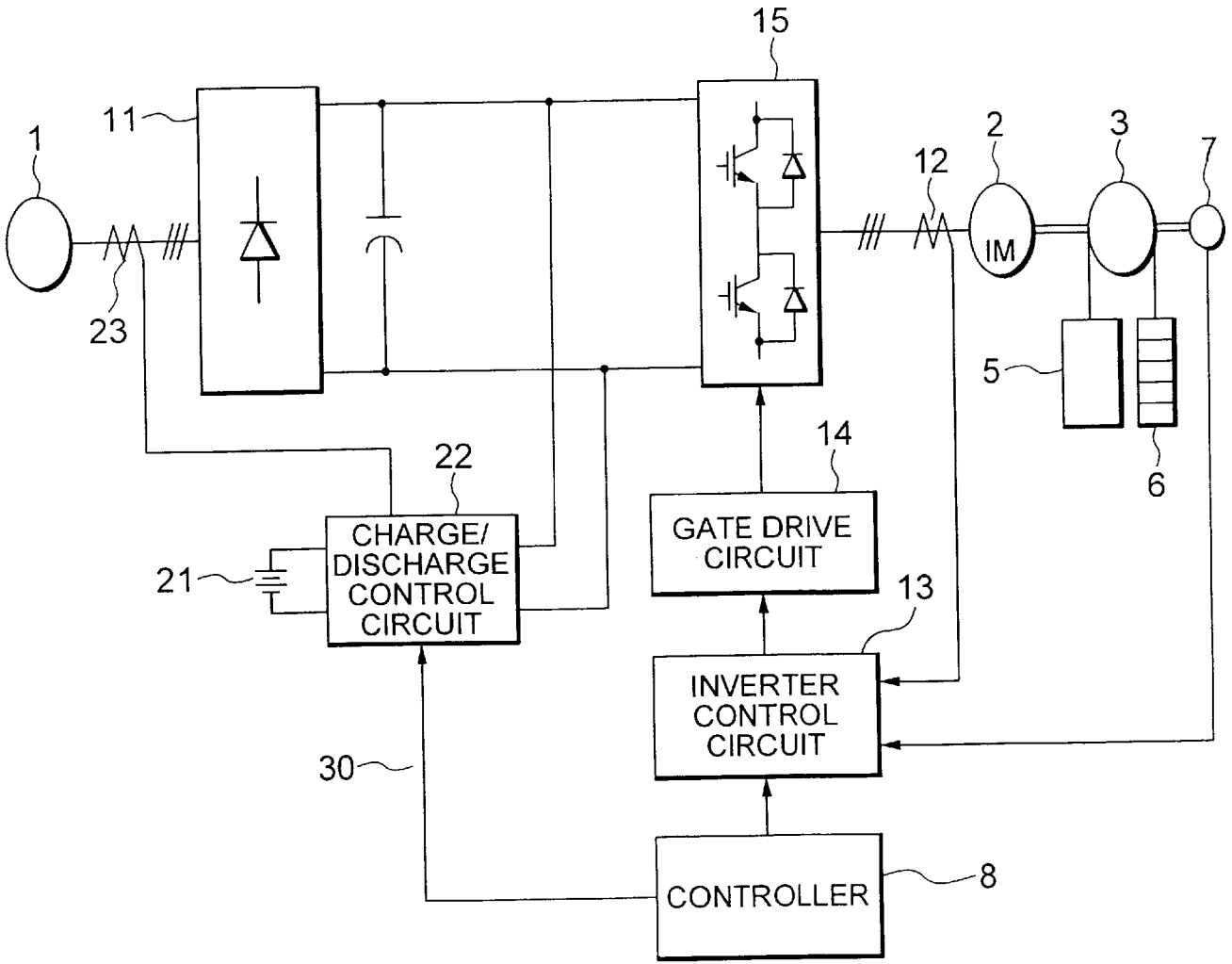
FIG. 4 schematically represents an arrangement of an elevator control apparatus according to an embodiment mode 3 of the present invention.

Referring now to FIG. 4, an elevator control apparatus according to a third embodiment mode of the present invention will be described. FIG. 4 is a structural diagram schematically indicating an arrangement of the elevator control apparatus according to this third embodiment. In FIG. 4, reference numeral 23 indicates a current detector. This current detector 23 is connected to the commercial power supply 1, the converter 11, and the charge/discharge control circuit 22. The current detector 23 measures a current value of the commercial power supply 1 so as to monitor electric power (KW) supplied from this commercial power supply 1.

Reference numeral 30 shows a power limit value which is supplied from the controller 8 to the charge/discharge control circuit 22.

In response to the entered power limit value 30, the recharging/discharging control circuit 22 supplies from both the commercial power supply 1 and the power storage apparatus 21, such electric power required when the elevator is operated in the powering operation mode.

It should be noted that the same reference numerals shown in the embodiment mode 1 of FIG. 1 will be employed as those for denoting the same, or similar circuit elements indicated in FIG. 4, the explanations thereof are omitted, and then only different circuit portions from those of FIG. 1 will be described.

Figure 5:
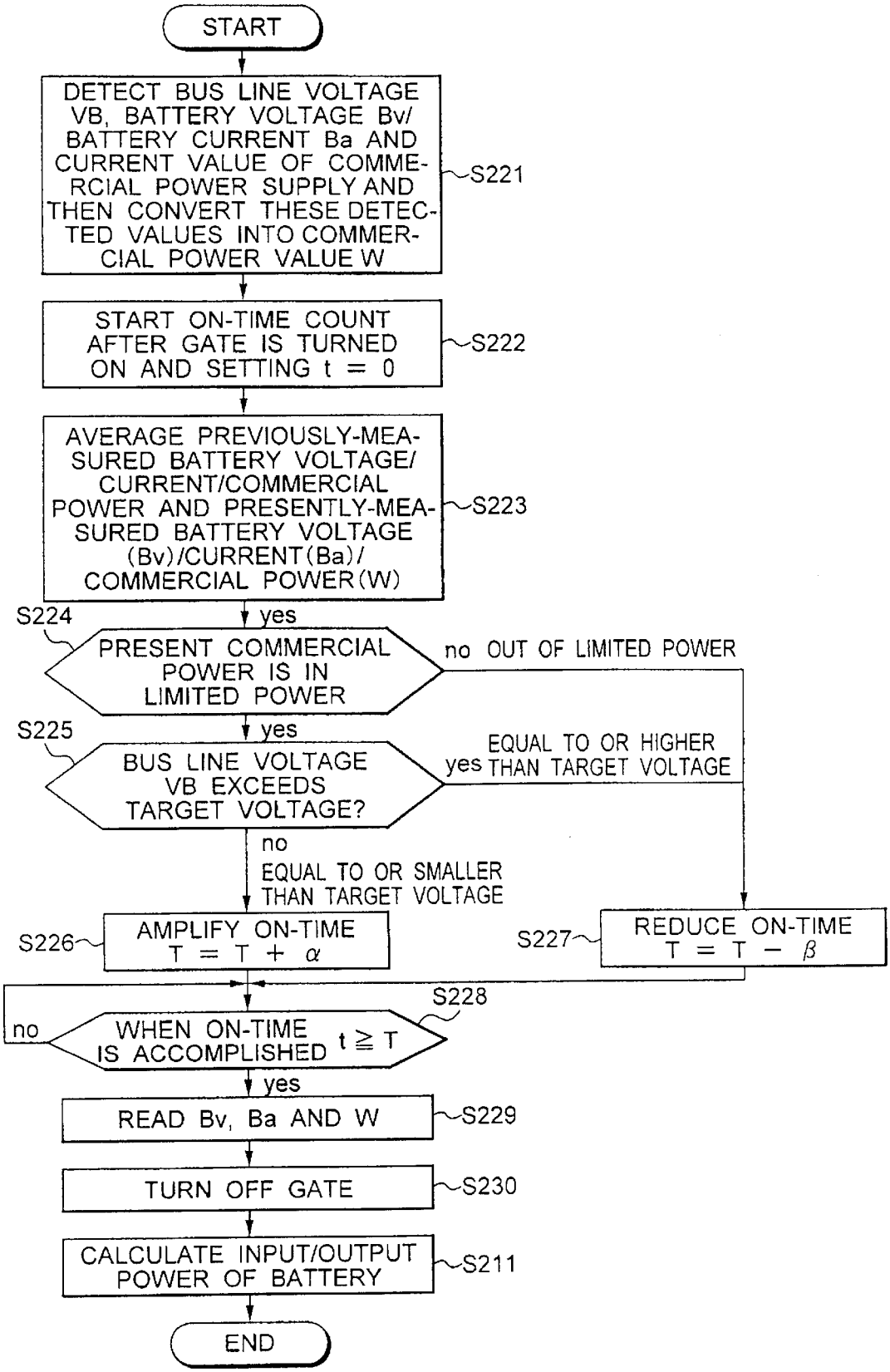
FIG. 5 is a flow chart describing an elevator control method executed by the third elevator control apparatus according to the embodiment mode 3 of the present invention.

Referring now to FIG. 5, a description will be made of an elevator control method executed in the elevator control apparatus according to this third embodiment mode. That is, FIG. 5 is a flow chart describing the elevator control method performed in the elevator control apparatus of the third embodiment mode.

In FIG. 5, at a S221, the charge/discharge control circuit 22 measures a bus line voltage "VB", and also measures an output voltage "Bv" of the power storage apparatus. Also, this charge/discharge control circuit 22 detects a current value of the commercial power supply 1 so as to calculate a commercial power value(W). When the process operation defined at this S221 is ended, the process operation is advanced to a S222.

At the S222, the charge/discharge control circuit 22 opens the gate of this charge/discharge control circuit 22. Then, this charge/discharge control circuit 22 starts to count a time period after the gate is opened, namely ON-time of this gate. Also, the charge/discharge control circuit 22 measures the output current Ba. When the process operation of this S222 is ended, the control operation is advanced to a S223.

At this S223, the charge/discharge control circuit 22 calculates an average value between the previously-measured output voltage Bv and the presently-measured output voltage Bv, and also another average value between the previously-measured output current Ba and the presently-measured output current Ba, and further calculates an average value between the previously-measured commercial power value W and the presently-measured commercial power value W. When the process operation defined at this S223 is ended, the process operation is advanced to a S224.

At this S224, the charge/discharge control circuit 22 judges as to whether or not the commercial power value W is in a predetermined limited power. When the commercial power value is in the predetermined limited power, the process operation is advanced to a S225. Otherwise, the process operation is advanced to a S227.

At the S225, the charge/discharge control circuit 22 judges as to whether or not the bus line voltage VB is equal to or higher than a target voltage. When the bus line voltage VB is equal to or higher than this target voltage, the process operation is advanced to a further S227. Otherwise, the process operation is advanced to a S226.

At this S226, the charge/discharge control circuit 22 amplifies the ON-time. When this process operation defined at the S226 is ended, the process operation is advanced to a S228.

At the S227, since the commercial power value W exceeds a predetermined limited power range, the charge/discharge control circuit 22 reduces, or shortens the ON-time. When this process operation defined at this S227 is ended, the process operation is advanced to a S228.

At the S228, the charge/discharge control circuit 22 judges as to whether or not a predetermined ON-time has been accomplished. When the predetermined ON-time has been accomplished, the process operation is advanced to a S229. Otherwise, the process operation is again returned to the previous S228 at which the process operation thereof is executed.

At the S229, the charge/discharge control circuit 22 measures both the output voltage Bv and the output current Ba, and also the commercial power value W. When the process operation defined at this S229 is ended, the process operation is advanced to a S230.

At this S230, the charge/discharge control circuit 22 closes the gate of the charge/discharge control circuit 22. When the process operation defined at this S230 is ended, the process operation is advanced to a S231.

At this S231, the charge/discharge control circuit 22 calculates input/output power with respect to the power storage apparatus 21.

As previously described, since the electric power (KW) supplied from the commercial power supply 1 is limited, the power supply apparatus can be manufactured in low cost. As a consequence, such a low-cost elevator control apparatus can be obtained with employment of the power source feeder having the energy-saving effect as a whole.

Embodiment Mode 4

Figure 6:
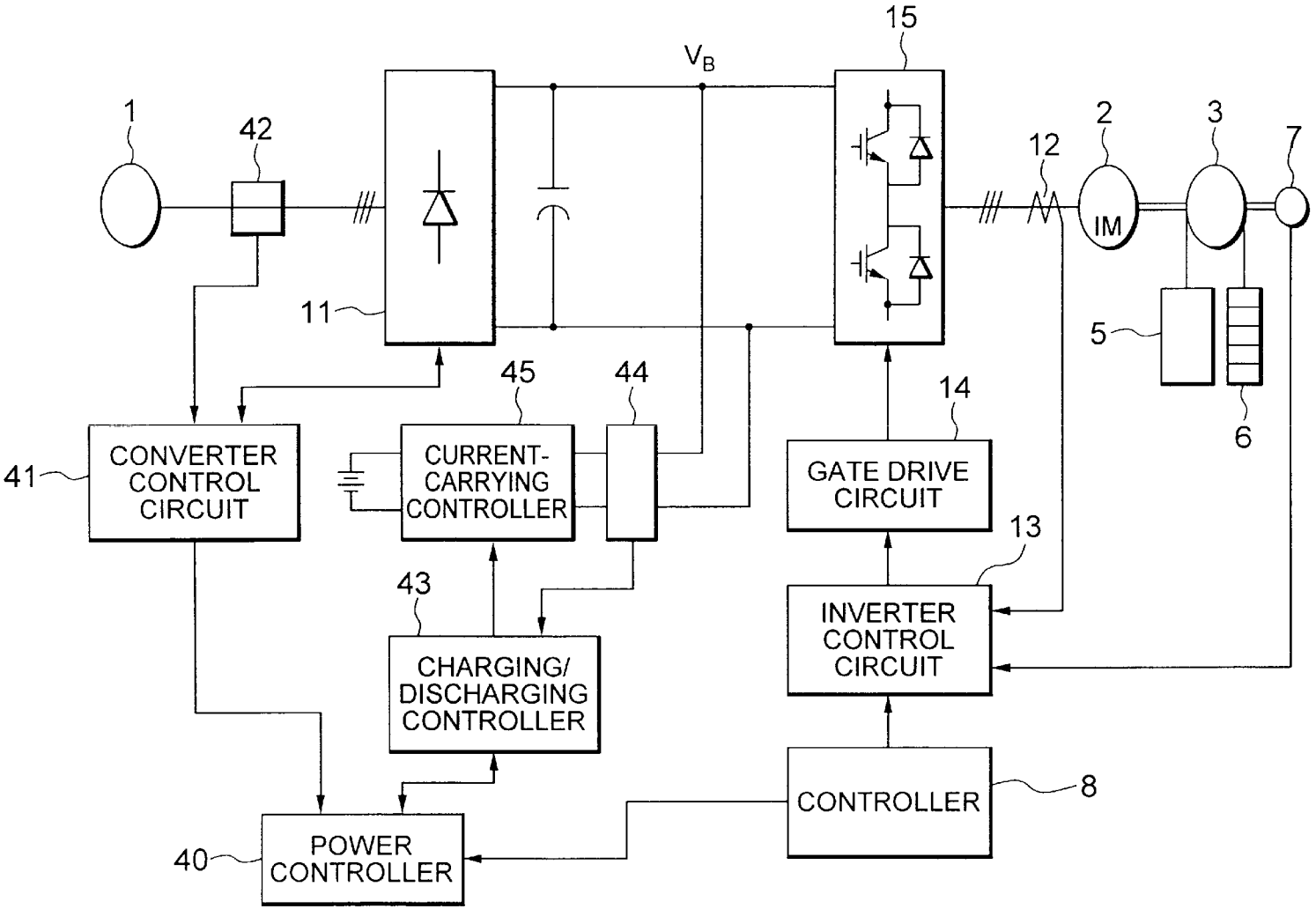
FIG. 6 schematically shows an arrangement of an elevator control apparatus according to an embodiment mode 4 of the present invention.

Referring now to FIG. 6, an elevator control apparatus according to a fourth embodiment mode of the present invention will be described. FIG. 6 is a structural diagram schematically indicating an arrangement of the elevator control apparatus according to this fourth embodiment mode. It should be noted that the same reference numerals shown in the embodiment mode 1 of FIG. 1 will be employed as those for denoting the same, or similar circuit elements indicated in FIG. 6, the explanations thereof are omitted, and then only different circuit portions form those of FIG. 6 will be described. In FIG. 6, reference numeral 40 indicates a power controller which is connected to a controller 8. In response to an instruction issued from the controller 8, this power controller 40 allocates electric power required for driving the elevator to both electric power of the commercial power supply and electric power stored in the power storage apparatus 21, controls the supply amounts of the electric power, and then instructs the relevant supply amounts to the respective power supplies. It should be understood that this controller 8 is a so-called "control panel."

Reference numeral 41 indicates a converter control circuit which is connected to both the converter 11 and the power controller 40. This converter control circuit 41 controls a power supply amount supplied from the commercial power supply 1 in response to an instruction issued from the power controller 40, namely controls a power conversion amount of the converter 11.

Reference numeral 42 indicates a commercial power detector which is connected to the commercial power supply 1, the converter 11, and the converter control circuit 41. This commercial power detector 42 detects an electric power amount supplied from the commercial power supply 1. As this detecting method, for instance, an electric power amount may be calculated based upon both a current and a voltage. Alternatively, while a current is measured, this measured current may be converted into an electric power amount. Furthermore, this commercial power detector 42 may detect an electric power amount by utilizing a control signal within the converter control circuit 41. It should also be noted that although this commercial power detector 42 is provided on the side of the commercial power supply 1 of the converter 11 in this fourth embodiment mode, this commercial power detector 42 may be provided on the output side of the converter 11.

Reference numeral 43 shows a charging/discharging controller which is connected to the power controller 40. In response to an instruction issued from the power controller 40, this charging/discharging controller 43 instructs/controls either a charging amount to the power storage apparatus 21 or a discharging amount from the power storage apparatus 21.

Reference numeral 44 denotes a charging/discharging power detector which is connected to the charging/discharging controller 43, bus lines between the converter 11 and the inverter 15. This charging/discharging power detector 44 detects either a charging amount or a discharging amount with respect to the power storage apparatus 21. In connection thereto, this charging/discharging power detector 44 detects a voltage value of a DC main circuit constructed of the converter 11 and the inverter 15.

Also, reference numeral 45 represents a current-carrying controller which is connected to the power storage apparatus 21, the recharging/discharging controller 43, and the charging/discharging power detector 44. In response to an instruction issued from the charging/discharging controller 43, this current-carrying controller 45 controls either a charging amount to the power storage apparatus 21 or a discharging amount from the power storage apparatus 21.

Figure 7:
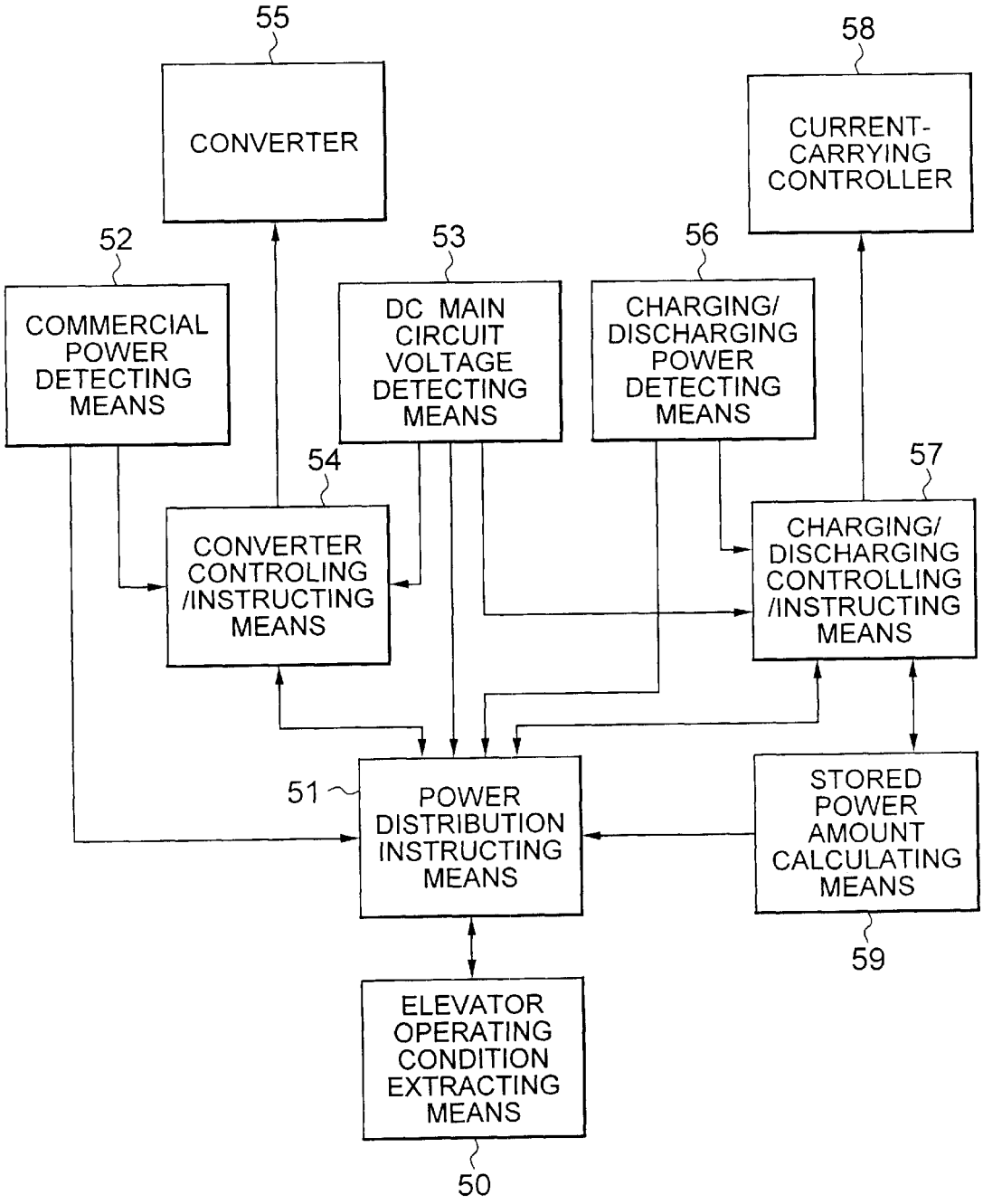
FIG. 7 is a functional block diagram representing a function of the elevator control apparatus according to the embodiment mode 4 of the present invention.

Next, various functions of the elevator control apparatus according to this fourth embodiment mode will now be explained with reference to FIG. 7. FIG. 7 is a functional block diagram indicative of various functions of the elevator control apparatus in this embodiment mode. In FIG. 7, reference numeral 50 shows an elevator operating condition extracting means for extracting an elevator operating condition related to driving operation of this elevator. Also, this elevator operating condition extracting means 50 selects an electric power supply source, and judges a supply ratio of electric power based upon data extracted in the post stage.

Reference numeral 51 indicates a power distribution instructing means. Based upon an instruction issued from this power distribution instructing means 51, a supply of electric power from the converter 11, a discharge operation from the power storage apparatus 21, and also a charge operation to the power storage apparatus 21 are respectively controlled. It should be understood that the discharge operation from the power storage apparatus 21 corresponds to the power supply operation from the power storage apparatus 21. These control operations by the power distribution instructing means 51 are judged based upon the distribution instructions of the power supply operation with respect to the converter 11 and the power storage apparatus 21, the operating condition of the elevator, the electric power amount charged into the power storage apparatus 21, and the voltage appearing at the DC main circuit. The operating conditions of the elevator indicate, for example, that the operation of the elevator corresponds to the powering operation, or the regenerative operation.

Also, reference numeral 52 represents a commercial power detecting means which corresponds to the commercial power detector 42. In other words, a total amount of electric power supplied from the commercial power supply 1 is detected by this commercial power detecting means 52.

Reference numeral 53 indicates a DC main circuit voltage detecting means which detects a bus line voltage of a DC main circuit between the converter 11 and the inverter 15. In other words, the function of this DC main circuit voltage detecting means 53 is equal to the function realized in the charging/discharging power detector 44. Since this bus line voltage is detected/monitored by the DC main circuit voltage detecting means 53, the elevator control apparatus can judge as to whether or not the operation of the elevator corresponds to the regenerative operation.

In general, the motor 2 of the elevator is energized by electric power to be rotatably driven, so that the car 5 of the elevator is driven. On the other hand, since the motor 2 is rotatably driven by an occurrence of unbalance condition in loads loaded on the car 5 and a balance weight 6, this motor 2 produces regenerative power. When the regenerative power is produced in this manner, this generative power is entered via the inverter 15 to the DC main circuit. Thereafter, the regenerative power entered into the DC main circuit is stored into a capacitor provided in this DC main circuit, so that this generative power finally boosts the bus line voltage of the DC main circuit. As a result of this reason, the detection of the bus line voltage of the DC main circuit is used to judge as to whether or not the operation of the elevator corresponds to the regenerative operation. Accordingly, when this bus line voltage is increased, it is possible to judge that the operation of the elevator is the regenerative operation.

It should be noted in this case that the load loaded on the car 5 involves the load of this car 5 itself and loads of passengers within the car 5.

Reference numeral 54 shows a converter controlling/instructing means which controls the converter 11 in response to an instruction outputted from the power distribution instructing means 51.

For instance, when it is so judged that the supply of electric power is required based upon the bus line voltage of the DC main circuit, namely when this bus line voltage is lower than a predetermined value, the converter controlling/instructing means 54 controls the converter 11.

Also, the converter controlling/instructing means 54 compares an electric power amount detected by the commercial power detecting means 52 with a distribution instruction value distributed-instructed by the power distribution instructing means 51. If the comparison result is within an allowable range, then the converter controlling/instructing means 54 controls the converter 11 within this allowable range.

Reference numeral 55 shows a converter which is similar to the above-explained converter 11. The converter 55 converts AC electric power of the commercial power supply 1 into DC electric power. Since a switching function is given to this converter 55, the converter 55 controls a voltage produced on the DC side, namely power to be converted. In this fourth embodiment mode, the converter 55 is explained as a switchable transistor converter. Alternatively, while a diode converter is used, this power supply amount may be indirectly controlled by the charging/discharging controller. In other words, "power supply amount from commercial power supply=overall required power amount−power supply amount from power storage apparatus.

Reference numeral 56 represents a charging/discharging power detecting means which corresponds to the charging/discharging power detector 44. The charging/discharging power detecting means 56 detects the charging amount to the power storage apparatus 21, the discharging amount from the power storage apparatus 21, and the bus line voltage of the DC main circuit.

Reference numeral 57 indicates a charging/discharging controlling/instructing means. This charging/discharging controlling/instructing means 57 controls that the power storage apparatus 21 is charged from the DC main circuit, and the power storage apparatus 21 discharges the stored electric power to the DC main circuit in accordance with the instruction issued from the power distribution instructing means 51 and the voltage condition of the bus line voltage in the DC main circuit.

For instance, when an increase in the bus line voltage of the DC main circuit is detected, this phenomenon occurs due to the following reason. That is, the elevator is driven in the regenerative operation, and then the regenerative power generated from this regenerative operation of the elevator is entered into the DC main circuit. To stabilize the bus line voltage in this DC main circuit, this regenerative power is charged into the power storage apparatus 21.

Also, when reduction in the bus line voltage of the DC main circuit is detected, the electric power stored in the power storage apparatus 21 is discharged therefrom and is supplied to the DC main circuit in order to stabilize the bus line voltage in this DC main circuit.

Reference numeral 59 shows a stored power amount calculating means. This stored power amount calculating means 59 accumulates the charging/discharging power amounts of the power storage apparatus 21, which are detected by the charging/discharging power detecting means 56 so as to calculate the power amount stored in this power storage apparatus 21.

Figure 8:
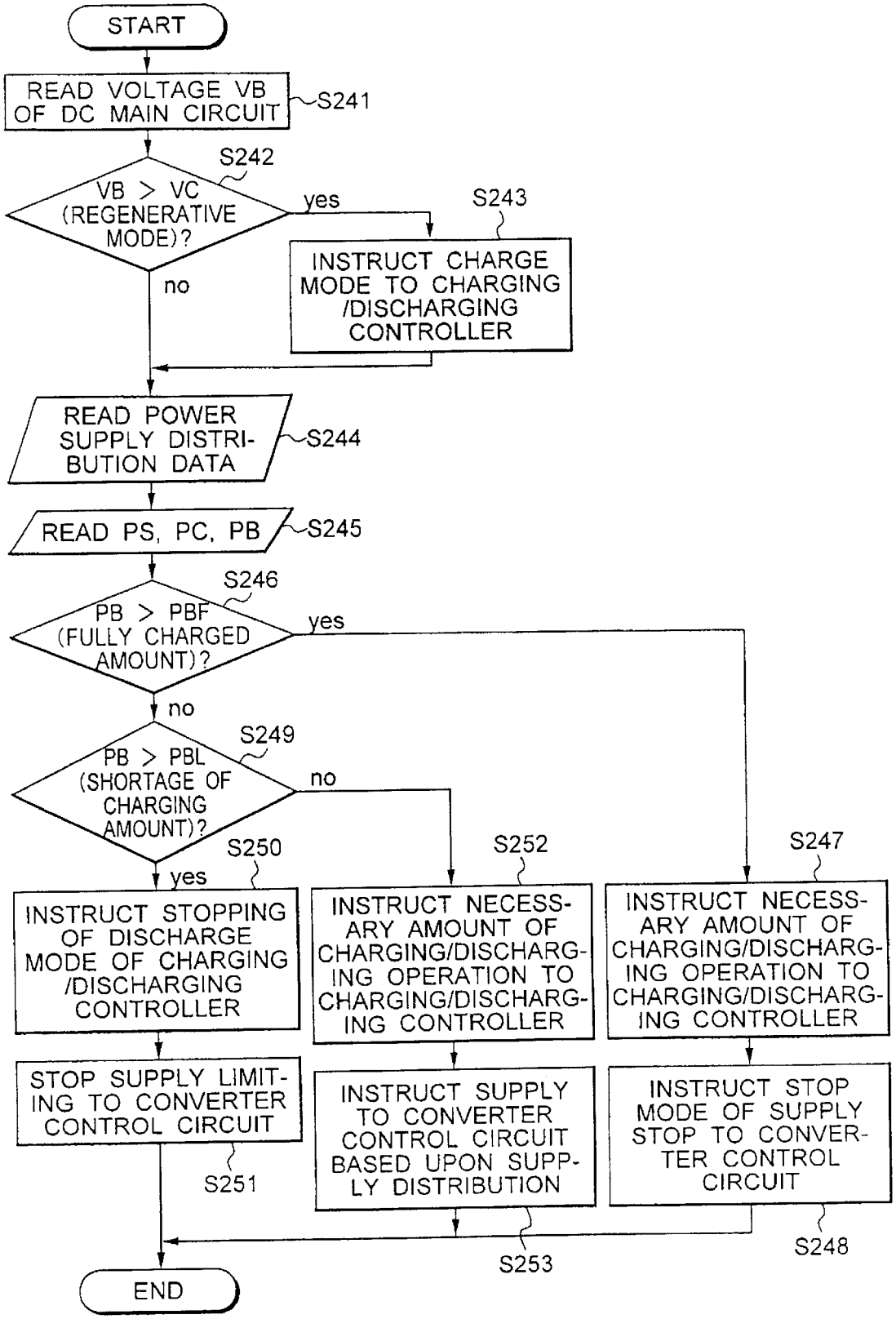
FIG. 8 is a flow chart describing an elevator control method executed in the elevator control apparatus according to the embodiment mode 4 of the present invention.

Referring now to FIG. 8, a description will be made of an elevator control method executed in the elevator control apparatus according to this fourth embodiment mode. That is, FIG. 8 is a flow chart describing the elevator control method performed in the elevator control apparatus in the fourth embodiment mode. In this flow chart of FIG. 8, symbol "Vc" shows a predetermined value used to judge that the operation mode of the elevator is the regenerative operation mode when the voltage of the DC main circuit exceeds this value; symbol "Ps" indicates an amount of electric power supplied from the commercial power supply 1, which is detected by the commercial power detecting means; symbol "Pc" denotes charging/discharging amounts with respect to the power storage apparatus, which are detected by the charging/discharging power detecting means; symbol "PB" represents an amount of electric power stored in the power storage apparatus, which is calculated by the stored power amount calculating means; symbol "PBF" shows a reference value used to judge that the power storage apparatus is fully charged, namely a spare value for regenerative power obtained by operating the elevator later with respect to the full charge operation; and symbol "PBL" indicates a reference value used to judge a shortage of charging amounts of the power storage apparatus.

In the flow chart of FIG. 8, at a S241, a bus line voltage "VB" of the DC main circuit is read. It should be understood that this bus line voltage VB is detected by the DC main circuit voltage detecting means 53. When the process operation defined at this S241 is ended, the process operation is advanced to a S242.

At this S242, a judgement is made as to whether or not the bus line voltage VB of this DC main circuit exceeds a predetermined voltage value Vc. If the bus line voltage VB of the DC main circuit exceeds a predetermined voltage value Vc, then it is judged that the elevator is driven in the regenerative operation mode, and therefore, the generated electric power must be absorbed. In other words, when the motor 2 of the elevator is driven in the regenerative operation mode, the resulting generative power is produced. This regenerative power is entered into the DC main circuit. As a result, the bus line voltage VB of the DC main circuit exceeds a predetermined voltage value Vc, so that the generated electric power is absorbed by the power storage apparatus 21, since the bus line voltage VB of the DC main circuit must be stabilized. When the bus line voltage VB exceeds a predetermined voltage value Vc, the process operation is advanced to a S243. Otherwise, the process operation is advanced to a S244.

At the S243, a control of a charge mode is instructed to the charging/discharging controller 43. In this charge mode, the electric power of the DC main circuit is charged into the power storage apparatus 21.

At the S244, power supply distribution data is read. In other words, such data is read which is related to the power supply distribution between the electric power supplied from the commercial power supply 1 and the electric power supplied from the power storage apparatus 21 based upon the operation information of the elevator entered into the controller 8. When the process operation defined at this S244 is ended, the process operation is advanced to a further S245.

At this S245, the commercial power amount Ps, the charging/discharging power amount Pc, and the charging power amount PB are read.

It should also be noted that the commercial power amount Ps is detected by the commercial power detector 42, and the charging/discharging power amount Pc is detected by the charging/discharging power detector 44. Also, the charging power amount PB corresponds to an amount of electric power stored in the power storage apparatus 21, and is calculated by the stored power amount calculating means 59. When the process operation defined at this S245 is ended, the process operation is advanced to a S246.

At this S246, a judgement is made as to whether or not the charging power amount PB exceeds a predetermined power amount PBF. In other words, such a judgement is made as to whether or not the charging power amount PB stored in the power storage apparatus 21 exceeds the predetermined power amount PBF and thus the power storage apparatus 21 is fully charged. When this charging power amount PB exceeds the predetermined power amount PBF, it is considered that the power storage apparatus 21 is fully charged. Therefore, a judgement is made such that it is not proper to further store the electric power with the power storage apparatus 21. Accordingly, such a control operation is carried out that the electric power stored in this power storage apparatus 21 is positively used. It should also be noted that as the electric power absorbed in the power storage apparatus 21, there is, for instance, regenerative power. When the charging power amount PB exceeds the predetermined power amount PBF, the process operation is advanced to a S247. Otherwise, the process operation is advanced to a S249.

At the S247, a necessary amount of charging/discharge operation is instructed to the charging/discharging controller 43. When the process operation defined at this S247 is ended, the process operation is advanced to a S248.

At the S248, a stop mode is instructed to the converter control circuit 41. This stop mode implies that the supply of electric power by the commercial power supply 1 is stopped. As previously explained, since the stop mode is instructed to the converter control circuit 41, the supply of electric power from the converter 11 is stopped. As a result, all of the electric power required to drive the elevator may be supplied from the power storage apparatus 21.

At this S249, a judgement is made as to whether or not the charging power amount PB becomes smaller than a predetermined power amount PBL. In other words, such a judgement is made as to whether or not the charging power amount PB stored in the power storage apparatus 21 is smaller than the predetermined power amount PBL and thus the charging amount of power storage apparatus 21 is shortage. When, it is judged that there is a shortage of the charging amount of the power storage apparatus 21, the stable power supply from this power storage apparatus 21 can not be carried out with ease. As a result, the supply of the electric power from the power storage apparatus 21 is temporarily stopped, and only the charge operation to the power storage apparatus 21 is executed. As a consequence, all of the electric power required to drive the elevator is supplied from the commercial power supply 1. It should also be noted that as the electric power charged to the power storage apparatus 21, there are regenerative power and commercial power. When the charging power amount PB becomes smaller than the predetermined power amount PBL, the process operation is advanced to a S250. Otherwise, the process operation is advanced to a S252.

At the S250, stopping of the supply of the electric power by the power storage apparatus 21 is instructed to the charging/discharging controller 43. Therefore, the power storage apparatus 21 is charged by employing only either the regenerative power or the commercial power. Under such a control operation, although the power storage apparatus 21 is charged, no discharge operation by this power storage apparatus 21 is carried out. In other words, the electric power is not supplied from the power storage apparatus 21, but the charging power amount stored in the power storage apparatus 21 is further increased. When the process operation defined at this S250 is ended, the process operation is advanced to a S251.

At this S251, when the power supply limitation is executed for the converter 11, the execution of this power supply limitation is stopped.

At a S252, a necessary amount of charging/discharging is instructed to the charging/discharging controller 43. In other words, the charging/discharging controller 43 controls the supply of the electric power and also the charge operation to the power storage apparatus 21 based upon the instructed power supply distribution. When the process operation defined at this S252 is ended, the process operation is advanced to a S253.

At this S253, a necessary amount of charging/discharging is instructed to the converter control circuit 41. That is to say, the converter control circuit 41 controls the supply of the electric power based on the instructed power supply distribution.

The power supply distributions instructed to both the converter control circuit 41 and the charging/discharging controller 43 are controlled in such a manner that the power supply amount from the commercial power supply 1 and the power supply amount from the power storage apparatus 21 may become a predetermined ratio.

Alternatively, the electric power is supplied from one power supply up to a predetermined power supply amount, and when such a power supply amount exceeding this predetermined power supply amount is required, the remaining power supply amount which exceeds this predetermined power supply amount may be supplied from the other power supply. As previously explained, since the supply of the electric power from one power supply, for example, the commercial power supply 1 is suppressed up to a predetermined power supply amount, the maximum power amount can be reduced. In particular, the power amount used during the peak power-consumption time period can be reduced. Also, the load of the elevator given to the building may be reduced in view of the capacity of this power supply facility.

As previously described, the elevator control apparatus, according to the present invention, is comprised of: the converter for rectifying AC electric power to be converted into DC electric power; the inverter for inverting the DC electric power into AC electric power having the variable voltage and the variable frequency; the motor driven by the AC electric power having the variable voltage and the variable frequency so as to operate the elevator; the power storage apparatus for charging thereinto DC electric power; and a power controller for controlling at least any one of the power storage apparatus and the commercial power supply in order to supply the electric power to the inverter. Since the power storage apparatus is combined with the commercial power supply, power consumption of the commercial power supply can be reduced. It is expected that this power reduction contributes to a great effect during the peak power-consumption time period.

Also, according to the power controller in the elevator control apparatus of the present invention, since the current value of the electric power supplied from the power storage apparatus is limited, the lifetime of this power storage apparatus can be extended.

Furthermore, according to the power controller in the elevator control apparatus of the present invention, since the maximum value of the power supply amount from the commercial power supply is controlled, the capacity of the power supply facility can be suppressed to a small capacity, and also the power rates can be reduced.

What is claimed is:

1. An elevator control apparatus for controlling power delivered from respective sources to power an elevator, the apparatus comprising:

a power storage apparatus for storing and supplying DC electric power;

a converter for rectifying AC electric power from a commercial power source to produce DC electric power;

an inverter for inverting DC electric power supplied from the power storage apparatus and the converter into AC electric power having a variable voltage and a variable frequency;

a motor driven by the AC electric power having the variable voltage and variable frequency and operating an elevator; and a power controller for controlling power supplied by both the power storage apparatus and the commercial power source to the inverter so that power is supplied to the motor from the power storage apparatus and the commercial power supply simultaneously, during normal operation of the elevator, in a ratio controlled to improve efficiency of electric power utilization by the inverter.

2. The elevator power control apparatus as claimed in claim 1 wherein a difference between power supplied to the inverter from one of the power storage apparatus and the commercial power supply and power demand of the inverter is supplied from the other of the power storage apparatus and the commercial power supply.

3. The elevator power control apparatus as claimed in claim 1 wherein said power controller detects a voltage appearing on a bus connecting the converter to the inverter to control power supplied from the power storage apparatus to the inverter.

4. The elevator power control apparatus as claimed in claim 1 wherein the power controller limits electrical current supplied from the power storage apparatus to the inverter.

5. The elevator power control apparatus as claimed in claim 1 wherein the power controller controls maximum power supplied from the power storage apparatus to the inverter.

6. The elevator power control apparatus as claimed in claim 1 wherein the power controller controls maximum power supplied from the commercial power supply to the inverter.

* * * * *